US008079235B2

(12) United States Patent
Plasencia

(10) Patent No.: US 8,079,235 B2
(45) **Date of Patent: *Dec. 20, 2011**

(54) CIRCULAR KNITTING MACHINE WITH BEARING-STABILIZED CYLINDER

(75) Inventor: Luis Plasencia, Monroe, NC (US)

(73) Assignee: Innovative Designs, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/856,991

(22) Filed: Aug. 16, 2010

(65) Prior Publication Data

US 2011/0079052 A1 Apr. 7, 2011

Related U.S. Application Data

(63) Continuation of application No. 12/571,849, filed on Oct. 1, 2009, now Pat. No. 7,793,523.

(51) Int. Cl.
*D04B 9/00* (2006.01)

(52) U.S. Cl. ..... 66/8

(58) Field of Classification Search ..... 66/7, 8, 66/56, 1 R; 384/548, 565, 618–620
See application file for complete search history.

(56) References Cited

U.S. PATENT DOCUMENTS

| | | | |
|---|---|---|---|
| 2,239,378 | A | 4/1941 | Brillhart |
| 2,705,410 | A | 4/1955 | Sirmay et al. |
| 3,317,258 | A | 5/1967 | Hermann |
| 3,421,344 | A | 1/1969 | Moyer et al. |
| 3,841,112 | A | 10/1974 | Uhlir et al. |
| 3,877,258 | A | 4/1975 | Uhlir |
| 3,934,431 | A | 1/1976 | Westmoreland, Sr. |
| 4,151,729 | A | 5/1979 | Micheletti |
| 4,221,120 | A | 9/1980 | Farmer |
| 4,226,485 | A | 10/1980 | Pruvot |
| 4,261,187 | A | 4/1981 | Yang |
| 4,339,932 | A | 7/1982 | Lonati |
| 4,346,571 | A | 8/1982 | Micheletti |
| 4,454,729 | A | 6/1984 | Lonati |
| 4,489,573 | A | 12/1984 | Engelfried et al. |
| 4,608,839 | A | 9/1986 | Tibbals, Jr. |
| 4,707,151 | A | 11/1987 | Kaiser |

(Continued)

FOREIGN PATENT DOCUMENTS

| | | | |
|---|---|---|---|
| EP | 0 541 838 | A1 | 5/1993 |

(Continued)

OTHER PUBLICATIONS

Search Report and Written Opinion for International Application No. PCT/US2010/050392, mailed Feb. 25, 2011; 12 pages.

*Primary Examiner* — Danny Worrell
(74) *Attorney, Agent, or Firm* — Alston & Bird LLP

(57) ABSTRACT

A retrofit to circular knitting machines that stabilizes the cylinder to reduce or eliminate wobbling or other undesired motion so that the machine can operate at a significantly higher speed. The cylinder is stabilized by a bearing system added to the knitting head of the machine. The bearing system includes a pair of bearings, one of the bearings being disposed above the other one. An inner race of each bearing is affixed to the cylinder and an outer race of each bearing is affixed to a bearing housing that is secured to the stationary base plate of the knitting head. The bearings help stabilize the cylinder so that its rotation axis remains essentially immovable and vertically oriented.

8 Claims, 2 Drawing Sheets

U.S. PATENT DOCUMENTS

| | | | |
|---|---|---|---|
| 5,031,421 | A | 7/1991 | Engelfried et al. |
| 5,133,196 | A | 7/1992 | Tibbals, Jr. |
| 5,170,645 | A | 12/1992 | Lonati et al. |
| 5,226,297 | A | 7/1993 | Manini |
| 5,275,020 | A | 1/1994 | Scherzinger |
| 5,390,707 | A | 2/1995 | Cahuzac |
| 5,493,876 | A | 2/1996 | Tsuchiya |
| 6,145,346 | A | 11/2000 | Hanyu et al. |
| 6,148,642 | A | 11/2000 | Conti |
| 6,269,664 | B1 | 8/2001 | Wang |
| 7,503,190 | B1 | 3/2009 | Knight, Sr. et al. |
| 2009/0266112 | A1 | 10/2009 | Traenkle |

FOREIGN PATENT DOCUMENTS

| | | |
|---|---|---|
| EP | 1 087 048 A2 | 3/2001 |

CIRCULAR KNITTING MACHINE WITH BEARING-STABILIZED CYLINDER

CROSS-REFERENCE TO RELATED APPLICATION

This application is a continuation of U.S. patent application Ser. No. 12/571,849 filed on Oct. 1, 2009 now U.S. Pat. No. 7,793,523.

BACKGROUND OF THE INVENTION

The present disclosure relates to circular knitting machines of the type having stationary cams and a rotating cylinder carrying knitting needles that are vertically reciprocated by engagement with the cams.

A circular knitting machine of the above-indicated type typically includes a knitting head that receives yarns from a set of yarn feeders spaced about the circumference of the machine. The knitting head includes a set of needles carried by a rotating cylinder, and in some machines the head also includes a dial that carries another set of needles that reciprocate horizontally and cooperate with cylinder needles; in other cases there are horizontally moving sinkers that act with the cylinder needles. As the cylinder rotates about a vertical axis, the cylinder needles are driven to move up and down in vertical channels or tricks defined in the cylinder, and the dial needles or sinkers are driven to move horizontally inward and outward in horizontal channels, and these knitting tools cooperate to form stitch loops so as to form a continuous tubular fabric. The fabric descends from the knitting head to a take-down unit that flattens the tube and draws it downward. The flattened fabric tube is wound into a roll by a winder/storage unit. The entire structure comprising the winder/storage unit and take-down unit rotates about the vertical axis along with the cylinder.

BRIEF SUMMARY OF THE DISCLOSURE

The present disclosure concerns an improvement applicable to a wide variety of circular knitting machines that can enable the machines to be operated at a higher rotational speed, for increased throughput and productivity.

The cylinder of a circular knitting machine can be prone to wobbling as it rotates (i.e., its rotation axis, which ideally is supposed to be vertical and immovable, undergoes a cyclic wobbling motion), and this tendency can increase as the speed of the machine increases. Wobbling of the cylinder can lead to undesirable consequences such as improper functioning (and possibly premature breaking) of the needles, because the cylinder needles move along with the cylinder. Thus, wobbling of the cylinder causes the cylinder needles to move along paths that cyclically deviate from the desired vertical paths. Improperly functioning or broken needles cause fabric defects, and necessitate machine down time in order to replace the bad needles.

The present disclosure describes an improvement to circular knitting machines that is designed to stabilize the cylinder to reduce or eliminate wobbling or other undesired motion of the cylinder. This can allow the machine to operate at a significantly higher speed. In accordance with the present disclosure, the cylinder is stabilized by a bearing system. In one embodiment, the bearing system comprises a pair of tapered roller bearings, one of the bearings being disposed above the other one, and the directions of taper of the two bearings generally being opposite each other. An inner race of each bearing is affixed to the cylinder and an outer race of each bearing is affixed to a bearing housing that is secured to the stationary base plate of the knitting head.

The tapered roller bearings help stabilize the cylinder so that its rotation axis remains essentially immovable and vertically oriented.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
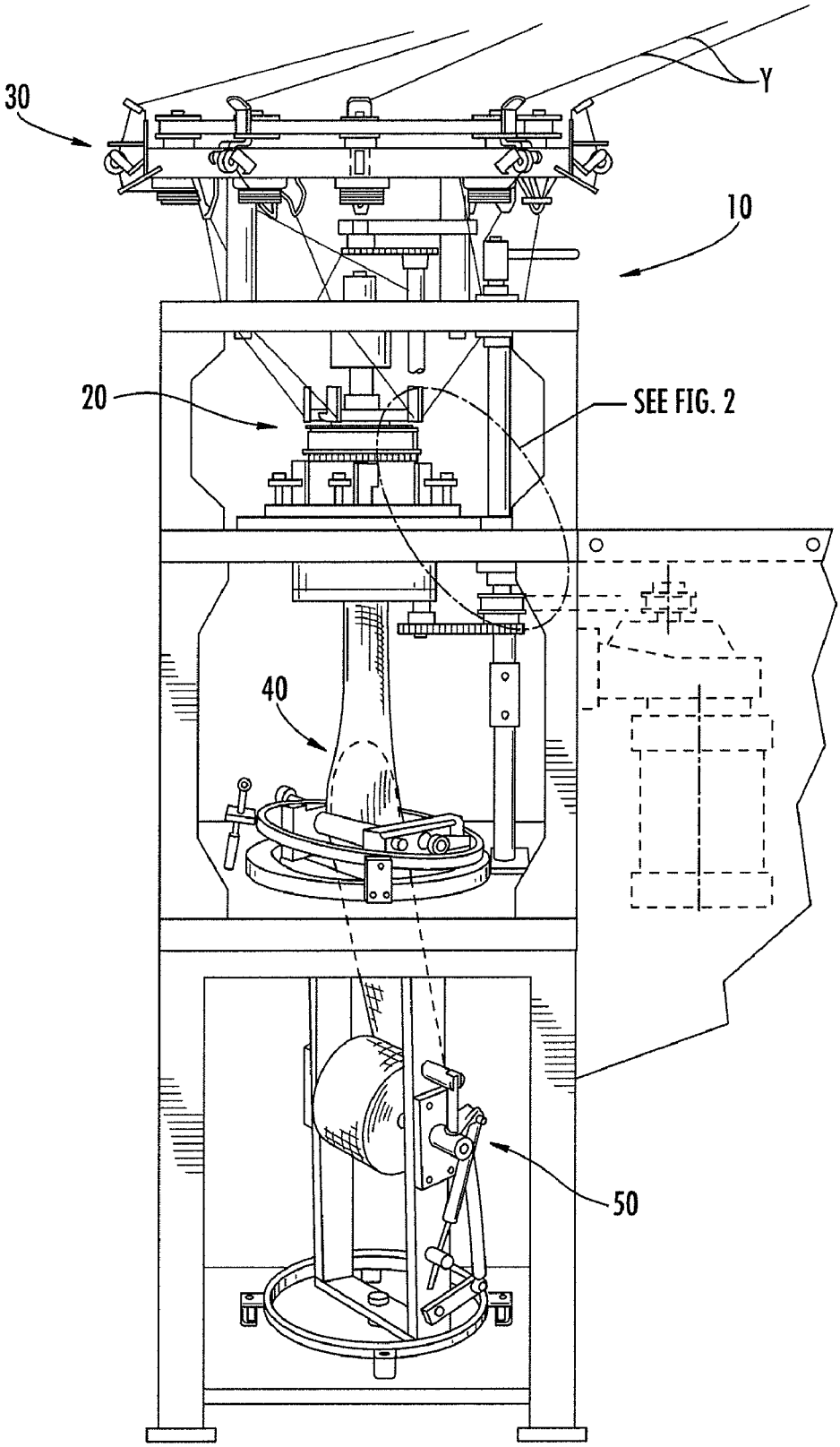
FIG. 1 illustrates a circular knitting machine in accordance with one embodiment of the invention.

FIG. 1 shows a circular knitting machine 10 in accordance with one embodiment of the present invention. The machine includes a knitting head 20 that receives yarns Y from a set of yarn feeders 30 spaced about the circumference of the machine. The knitting head 20, shown in greater detail in FIG. 2, includes a set of needles 22 carried by a rotating cylinder 24, and in some machines the head also includes another set of needles 26 carried by a dial 28; in other cases there are sinkers (not shown) instead of dial needles. As the cylinder 24 rotates about a vertical axis, the cylinder needles 22 are driven to move up and down in vertical channels or tricks defined in the cylinder, and the dial needles 26 or sinkers are driven to move horizontally inward and outward in horizontal channels defined in the dial 28, and these knitting tools cooperate to form stitch loops so as to form a continuous tubular fabric F. The fabric descends from the knitting head 20 to a take-down unit 40 that flattens the tube F and draws it downward. The flattened fabric tube is wound into a roll R by a winder/storage unit 50. The entire structure comprising the take-down unit 40 and winder/storage unit 50 rotates about the vertical axis along with the cylinder 24.

Figure 2:
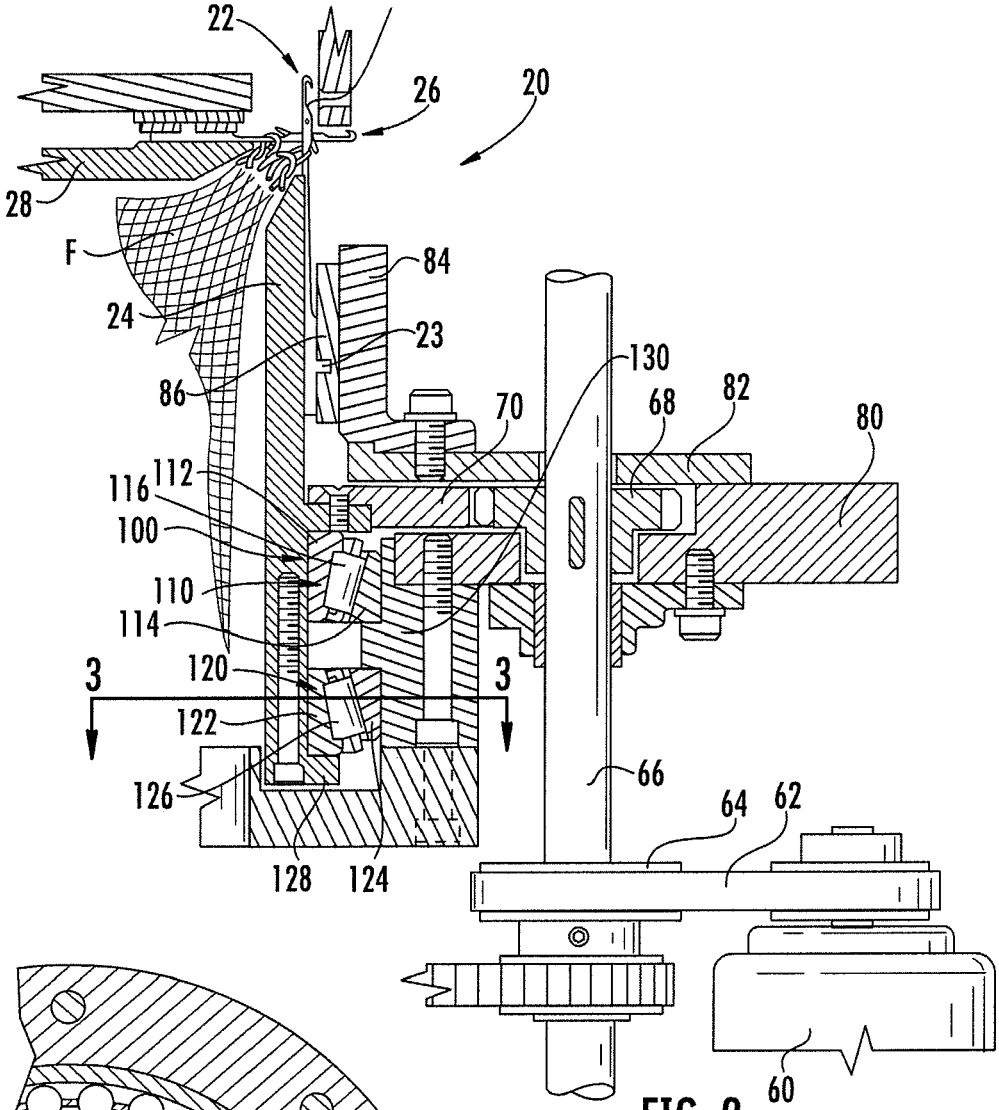
FIG. 2 is a magnified view of a portion of the machine of FIG. 1, partly in section to show internal details of the machine.

With reference to FIG. 2, the cylinder 24 is driven to rotate about a vertical axis by a motor 60 that drives a belt 62 looped about a sprocket 64 that is affixed to a vertical drive shaft 66. The drive shaft 66 is affixed to a drive pinion 68, which in turn engages a cylinder drive gear 70 affixed to the cylinder 24. Thus, rotation of the drive shaft 66 by the motor 60 causes the cylinder 24 to rotate about its vertical axis. The illustrated arrangement for driving the cylinder 24 is only exemplary, and the present invention is not limited to any particular drive arrangement.

The machine includes a stationary base plate 80 that provides support for a number of structures and components. A cam plate 82 is supported on the base plate 80. Affixed to the cam plate 82 is a cam box 84 that surrounds the radially outer side of the cylinder 24. The cam box has a plurality of needle cams 86 affixed to its radially inwardly facing side, opposing the cylinder 24. The cams 86 define cam tracks that interact with butts 23 on the needles 22. The cylinder needles 22 are driven up and down by engagement of the butts 23 with the cam tracks as the needles are carried along by the rotating cylinder 24.

As previously noted, the cylinder 24 can be prone to wobbling as it rotates (i.e., its rotation axis, which ideally is supposed to be vertical and immovable, undergoes a cyclic wobbling motion), and this tendency can increase as the speed of the machine increases. Wobbling of the cylinder can lead to undesirable consequences such as improper functioning (and possibly premature breaking) of the needles 22, because the cylinder needles 22 move along with the cylinder 24. Thus, wobbling of the cylinder causes the cylinder needles 22 to move along paths that cyclically deviate from the desired vertical paths. Improperly functioning or broken needles 22 cause fabric defects, and necessitate machine down time in order to replace the bad needles.

Figure 3:
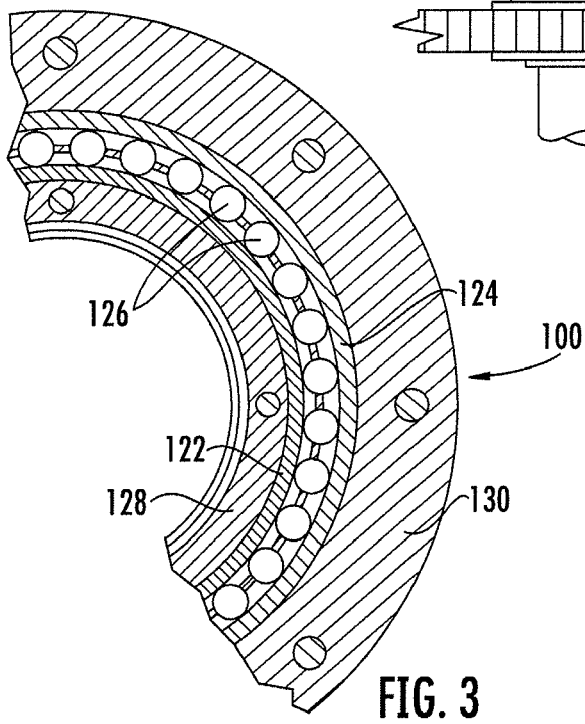
FIG. 3 is a cross-sectional view along line 3-3 in FIGS. 2.

The present disclosure describes an improvement to circular knitting machines that is designed to stabilize the cylinder to reduce or eliminate wobbling or other undesired motion of the cylinder. This can allow the machine to operate at a significantly higher speed. In accordance with the present disclosure, the cylinder 24 is stabilized by a bearing system 100. In one embodiment as shown in FIGS. 2 and 3, the bearing system 100 comprises a pair of bearings 110 and 120. The bearing 110 is disposed above and vertically spaced from the other bearing 120. In one embodiment the bearings 110, 120 can be tapered roller bearings, and the directions of taper of the two bearings can be generally opposite (towards) each other. Other equivalent types of bearings known to persons skilled in the bearing art could be used instead.

More particularly, in the illustrated embodiment the bearing system 100 includes a ring-shaped inner race 112 for the upper bearing 110, and a ring-shaped inner race 122 for the lower bearing 120, the inner races 112 and 122 being affixed to the cylinder 24 for rotation therewith. A ring-shaped outer race 114 for the upper bearing and a ring-shaped outer race 124 for the lower bearing are secured to a stationary bearing housing 130 that is affixed to the base plate 80. A plurality of bearing elements such as conical tapered rollers 116 are captured between the inner and outer races 112, 114 of the upper bearing 110, and a plurality of bearing elements such as conical tapered rollers 126 are captured between the inner and outer races 122, 124 of the lower bearing 120. Each bearing includes a cage for retaining the bearing elements. The rollers 116 taper in a generally downward direction, and the rollers 126 taper in a generally upward direction. The rotation axes of the rollers 116, 126 are inclined relative to the rotation axis of the cylinder 24. In the illustrated bearing system, the rotation axes of the two sets of tapered rollers converge in a radially inward direction. The inner races 112, 122 are shown as separate parts, but can instead be integral with each other, and likewise for the outer races 114, 124.

The cylinder 24 is affixed to the inner races 112, 122, and therefore the bearing elements 116, 126 constrain the cylinder 24 to rotate about the vertical rotation axis defined by the bearing system 100. Accordingly, the bearing system helps stabilize the cylinder 24 so that its rotation axis remains essentially immovable and vertically oriented. The vertical spacing between the two bearings 110, 120, the tapered nature of the rollers 116, 126, and the generally opposite taper directions of the rollers all contribute toward stability of rotation of the cylinder 24. The improved stability of the cylinder's rotation allows the cylinder to be rotated at significantly higher speeds than would otherwise be possible if the bearing system 100 were not present, thereby improving the productivity of the circular knitting machine.

In the illustrated embodiment, the inner races 112, 122 are secured to the cylinder 24 by a generally ring-shaped retaining member 128 that essentially forms a lower extension of the cylinder 24 and is affixed to the lower end of the cylinder by machine screws, bolts, or the like. The inner races are captured between a lower flange on the retaining member 128 and an upper flange extending from the cylinder 24.

In accordance with the invention the bearing system can be retrofit into various existing models of circular knitting machines. The illustrated embodiment has the bearing system 100 disposed generally below the base plate 80 of the knitting head, but alternatively in some circular knitting machines the bearing system could be above the base plate.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A circular knitting machine, comprising:

(a) a knitting head fed with yarns and operable to knit a continuous fabric tube, the knitting head comprising:

a stationary base plate;

a plurality of needles carried by a rotating cylinder, the cylinder having an upper portion disposed above the base plate and a lower portion disposed below the base plate, the needles being movable up and down in vertical channels defined in the upper portion of the cylinder, the cylinder being rotatable about a cylinder axis;

a vertical drive shaft rotatable about an axis displaced from the cylinder axis;

a drive pinion affixed to the drive shaft and a cylinder drive gear affixed to the cylinder, the drive pinion engaging the cylinder drive gear such that rotation of the drive shaft causes rotation of the cylinder about the cylinder axis;

a cam box supported by the base plate and configured to surround a radially outer surface of the cylinder;

a plurality of needle cams affixed to a radially inwardly facing side of the cam box opposing the cylinder, the cams interacting with butts on the needles such that the needles are driven up and down as the needles are carried along by the rotating cylinder;

(b) a take-down unit receiving the fabric tube descending from the knitting head and operable to flatten the fabric tube;

(c) a wind-up and storage unit receiving the flattened fabric tube from the take-down unit and operable to wind the flattened fabric tube into a roll; and (d) a bearing system incorporated into the knitting head and comprising first and second bearings surrounding the cylinder and constraining the cylinder to rotate about the cylinder axis defined by the bearing system, the first bearing being disposed above and vertically spaced from the second bearing, the first and second bearings comprising:

a ring-shaped inner race for the first bearing, and a ring-shaped inner race for the second bearing, the inner races being affixed to the cylinder for rotation therewith;

a ring-shaped outer race for the first bearing and a ring-shaped outer race for the second bearing, the outer races being secured to the base plate; and a plurality of first bearing elements captured between the inner and outer races of the first bearing, and a plurality of second bearing elements captured between the inner and outer races of the second bearing.

2. The circular knitting machine of claim 1, whereby the bearing system is disposed generally below the base plate.

3. The circular knitting machine of claim 1, wherein the bearing system is disposed generally above the base plate.

4. The circular knitting machine 1, wherein the inner race of at least the first bearing is disposed directly against the radially outer surface of the cylinder.

5. The circular knitting machine of claim 1, wherein the inner races of the first and second bearings are separate parts.

6. The circular knitting machine of claim 1, wherein the outer races of the first and second bearings are separate parts.

7. The circular knitting machine of claim 1, wherein the outer races are surrounded by a bearing housing, the bearing housing being affixed to the base plate.

8. A knitting head for a circular knitting machine, the knitting head comprising:

a stationary base plate;

a plurality of needles carried by a rotating cylinder, the cylinder having an upper portion disposed above the base plate and a lower portion disposed below the base plate, the needles being movable up and down in vertical channels defined in the upper portion of the cylinder, the cylinder being rotatable about a cylinder axis;

a vertical drive shaft rotatable about an axis displaced from the cylinder axis;

a drive pinion affixed to the drive shaft and a cylinder drive gear affixed to the cylinder, the drive pinion engaging the cylinder drive gear such that rotation of the drive shaft causes rotation of the cylinder about the cylinder axis;

a cam box supported by the base plate and configured to surround a radially outer surface of the cylinder;

a plurality of needle cams affixed to a radially inwardly facing side of the cam box opposing the cylinder, the cams interacting with butts on the needles such that the needles are driven up and down as the needles are carried along by the rotating cylinder; and a bearing system incorporated into the knitting head and comprising first and second bearings surrounding the cylinder and constraining the cylinder to rotate about the cylinder axis defined by the bearing system, the first bearing being disposed above and vertically spaced from the second bearing, the first and second bearings comprising:

a ring-shaped inner race for the first bearing, and a ring-shaped inner race for the second bearing, the inner races being affixed to the cylinder for rotation therewith;

a ring-shaped outer race for the first bearing and a ring-shaped outer race for the second bearing, the outer races being secured to the base plate; and a plurality of first bearing elements captured between the inner and outer races of the first bearing, and a plurality of second bearing elements captured between the inner and outer races of the second bearing.

* * * * *